United States Patent [19]

Sable

[11] Patent Number: 4,997,039

[45] Date of Patent: Mar. 5, 1991

[54] ROD CENTRALIZER

[75] Inventor: Donald E. Sable, Dallas, Tex.

[73] Assignee: McClung-Sable Partnership, Dallas, Tex.

[21] Appl. No.: 505,369

[22] Filed: Apr. 6, 1990

[51] Int. Cl.[5] ..... E21B 17/10

[52] U.S. Cl. ..... 166/241; 175/325

[58] Field of Search ..... 166/241, 173, 176; 175/325

[56] References Cited

U.S. PATENT DOCUMENTS

| | | | |
|---|---|---|---|
| 2,659,439 | 11/1953 | Baker | 166/241 |
| 3,250,578 | 5/1966 | Lubbes | 175/325 |
| 3,484,141 | 12/1969 | Collett | 166/241 |
| 3,916,998 | 11/1975 | Bass, Jr. et al. | 166/241 |
| 4,600,063 | 7/1986 | Beasley | 166/241 |
| 4,809,777 | 3/1989 | Sable | 166/241 |

*Primary Examiner*—Bruce M. Kisliuk

[57] ABSTRACT

A centralizer for a pump rod string which minimizes the resistance offered thereby to flow of well fluids therepast having a body provided with two pairs of longitudinally and circumferentially spaced radially outwardly extending ribs and a circumferential area of reduced external diameter between the two pairs of ribs providing a circumferential line of reduced mechanical strength to minimize likelihood of occurrence of longitudinal cracks in the body of the centralizer and minimizing flaking of the body when the body is subjected to strains and stresses due to bending of the rod, on which it is rigidly mounted, about axes substantially perpendiculer to the longitudinal axis of the rod and also providing flow passages of increased area between the two pairs of ribs.

3 Claims, 1 Drawing Sheet

ROD CENTRALIZER

This application relates to well tools and more particularly to centralizers for pump rod strings.

BACKGROUND OF THE INVENTION

The usual apparatus for pumping well fluids from a well to the surface, through a tubing which extends from the surface to below a fluid producing formation penetrated by the well, includes a pump connected to the lower end of the tubing which has a plunger or "traveling valve" which is reciprocated in the longitudinal barrel of the pump by a string of pump rods, the bottom rod being connected to the traveling valve, the top rod of the rod string being connected to a motor driven means for alternately pulling the string upwardly and then allowing the string to be moved downwardly by gravity.

Since the weight of the pump rod string provides the force necessary to cause well fluids to flow upwardly through the tubing, if resistance to the downward movement of string of tubing by the upwardly flowing well fluids is great, especially past such obstructions to fluid flow as centralizers or scrapers mounted on the rods, the rod string will move downwardly relatively slowly thus reducing the rate of production of the well fluids. The centralizers decrease the flow space area between the rod and the tubing. In addition, if the pump and lower end portions of the rod string offer a relatively great resistance to downward movement of the rod string, the weight of upper portions of the rod string may cause lower portions of the rod string to be placed under great compression loads which tend to cause such lower portions to bend and buckle and their centralizers to be moved with great force against the internal surfaces of the tubing.

Centralizers which provide a relatively low resistance to upward flow of well fluids therepast, and therefore to the downward movement of the rod string in the tubing, have been disclosed in United States Letters Patent to Donald E. Sable, No. 4,809,777 issued Mar. 7, 1989.

These centralizers are formed of a hard, durable, but somewhat brittle, plastic, such as is available commercially under the trademark "RYTON", molded on the rod. The centralizers have a longitudinal body of relatively long length to provide a large area of contact with and adherence to the rod and therefore a great resistance to any forces tending to displace or move the centralizers longitudinally relative to and on the rod.

The centralizers have two pairs of ribs spaced longitudinally from each other by an intermediate portion of the body, integral with and extending radially outwardly from the body. The ribs must be of substantial length to provide relatively large areas of contact with the tubing to minimize the force per unit of area between the tubing and the ribs when the rods on which the centralizers are moved laterally in the tubing.

Due to the relatively long length of the body of such centralizers, if the rod itself is bent, which sometimes occurs during the handling of the rod or of sections of the rod string composed of several connected rods during the installation in and removal of the rod string from the tubing, the forces exerted on the centralizer body are sometimes so great that the intermediate portion of the body cracks and the cracks so caused extend most frequently longitudinally between the two pairs of longitudinally spaced pairs of ribs at the outer curvature of the bending where the intermediate portion of the body is placed under tension. At the same time, the portions of the intermediate portion of the body at the inner curvature of the bending are placed under compression and outer portions thereof may flake off. Obviously, the greater the diameter of the intermediate portion, the greater will be such tension and compression forces.

Such longitudinal cracking of the centralizer body of course weakens the force with which the body grips the rod permitting its subsequent longitudinal displacement on the rod when its ribs engage the tubing during longitudinal movement of the rod string in the tubing. In addition, cracked off portions of the centralizers may actually separate from the rod and interfere with the longitudinal movement of the rod string in the tubing and cause damage to the tubing and the rod string. In addition, costly downtime is required to replace such damaged centralizers and remove cracked off pieces of the centralizers from the tubing.

OBJECTS OF THE INVENTION

It is therefore an object of this invention to provide centralizers for the rods of the pump rod string which will hold the rods in central longitudinal alignment with and in the tubing while presenting a minimal resistance to the upward flow of fluids therepast.

Another object is to provide centralizers which have substantially no downward facing surfaces which extend transversely perpendicularly to the vertical axis of the rod, such surfaces creating turbulence and resistance to upward fluid flow past the centralizers and thus increase resistance to downward movement of the rod string in the tubing.

Another object of the invention is to provide a centralizer having a longitudinal body and longitudinally spaced pairs of radially outwardly extending opposed ribs integral therewith, one pair being displaced 90 degrees from the other relative to the central longitudinal axis of the centralizer, wherein the body has an intermediate portion between the pairs of ribs which provides a circumferential area of reduced mechanical strength, this circumferential area permitting circumferential cracking of the body between the pairs of ribs in the event excessive lateral forces tend to cause bending of the rod on which the centralizer is rigidly mounted before such excessive forces can cause longitudinal cracks in the centralizer body.

Another object is to provide a centralizer, of the type described, wherein the intermediate portion is of smaller external diameter than the end portions provided with the ribs.

SUMMARY OF THE INVENTION

The centralizer of the invention, formed of a durable plastic and moulded rigidly on the pump rod, has a longitudinal body, an upper pair of ribs extending outwardly from the body in opposite directions and a pair of similar ribs displaced 90 degrees on the body relative to the upper pair. The bottom ends of the upper ribs are spaced from the top ends of the lower ribs by an intermediate portion of the body of reduced diameter and of reduced mechanical strength to preclude longitudinal cracking and flaking of the body at the intermediate portion, and to increase the area of the flow passage between the pairs of ribs.

DESCRIPTION OF THE DRAWINGS

Other objects and advantages of the invention will be readily apparent from the reading of the following description of a centralizer constructed in accordance with the invention and reference accompanying drawings, wherein.

Figure 1:
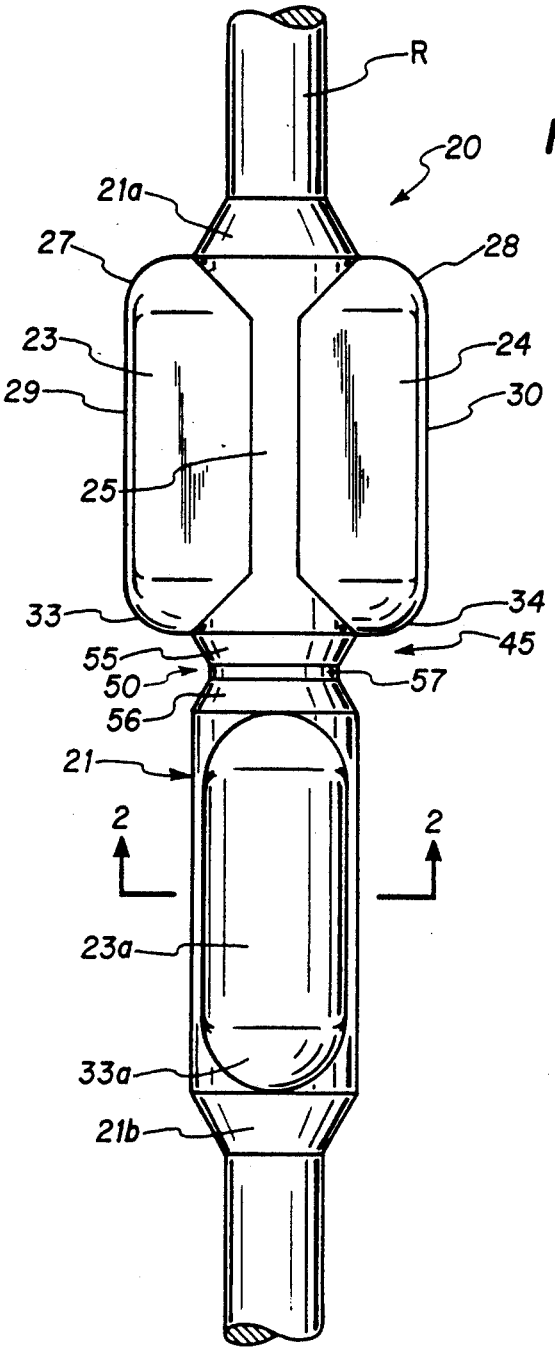
FIG. 1 is a longitudinal plan view of a centralizer embodying the invention shown mounted on a rod; and, FIG. 2 is a cross-sectional view taken on line 2—2 of FIG. 1.

Referring now to the drawings, the centralizer 20 embodying the invention, shown mounted on a rod R, has a body 21 whose opposite upper and lower end surfaces 21*a* and 21*b*, respectively, extend divergently inwardly to the rod. An upper pair of ribs 23 and 24 extend radially outwardly, in opposite directions from the circular outer surface 25 of the body.

The top end surfaces 27 and 28 of the ribs 23 and 24, respectively, extend substantially arcuately and downwardly from the lower end of the top surface 21*a* to the vertical surfaces 29 and 30 of the ribs 23 and 24, respectively.

Similarly, the bottom surfaces 33 and 34 of the ribs 23 and 24, respectively, curve downwardly and inwardly from the lower ends of their vertical surfaces 29 and 30, respectively, to the surface 25 of the body.

The outer vertical surfaces of the ribs lie in a circle whose diameter is slightly less than the internal diameter of the tubing in which the rod string provided with centralizers is to be used.

The lower pairs of ribs 23*a* and 24*a* have the same configuration as the upper ribs and, accordingly, the various surfaces of the ribs 23*a* and 24*a* are provided with the same reference numbers, to which the subscript "a" has been added, as the corresponding surfaces of the ribs 23 and 24, respectively.

The top ends of the lower ribs are spaced from the bottom ends of the top pair of ribs by an intermediate circumferential body portion 45 to facilitate flow of well fluids between the longitudinal flow channels defined by the ribs 23 and 24 and the longitudinal flow channels defined by the ribs 23*a* and 24*a*.

Figure 2:
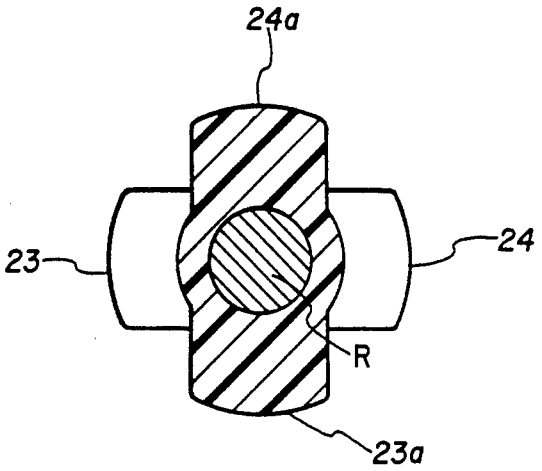

It will be seen in FIG. 2 that the ribs of the upper and lower pairs of ribs are of shorter widths than the flow channels they define so that portions of the channels defined by the upper ribs are in alignment with the channels defined by the lower ribs. As a result, with the provisions of the vertical spacing between the upper and lower pairs of ribs, and the elimination of any surfaces which lie in planes substantially transverse to the longitudinal axis of the centralizer, the centralizer of the invention minimizes the resistance presented thereby to fluid flow therepast in the tubing.

Such resistance to flow is further reduced by providing the intermediate body portion 45 with a circumferential groove 50 defined by the upper and lower annular surfaces 55 and 56, respectively, which extend convergently inwardly to the circular surface 57 defining the bottom of the groove.

The upper surface 55 extends to the surface 57 downwardly and inwardly from the bottom ends of the upper ribs 23 and 24 and the lower surface 56 extends upwardly and inwardly from the top ends of the lower ribs 23*a* and 24*a*.

It will be apparent that the annular surface 57 is of much smaller diameter than the diameter of the portions of the body provided with the ribs.

As a result, the body portion of reduced external diameter defined by the surface 57 is of much smaller mechanical strength than the other body portions which extend in opposite longitudinal directions therefrom.

While the surface 57 is shown as lying in a cylindrical plane concentric with the central longitudinal axis of the 21, it may of course be arcuate in form relative to the longitudinal axis. The centralizers are formed of a tough durable plastic, such as polyphenylene sulfide, commercially available under the trademark "RYTON", which is molded on the pump rods. The RYTON substance, as it cools, tends to contract and grip the rods with a considerable compressive force. It will be evident that the greater the area of that rod centralizer in contact with the rod, the greater will be the force with which it is held against movement on the rod.

The described and illustrated centralizer has twice the length of conventional centralizers and obviously will resist longitudinal displacement on the rods on which they are mounted, as by inadvertent blows during make-up and break-down of a pump rod string or by contact with internal surfaces of the tubing in which the rod string is disposed, much better than conventional centralizers.

It will now be apparent that if the rod on which a centralizer is rigidly mounted is subjected to forces which tend to bend it laterally to such degree that the centralizer is subjected to excessive bending forces, the circumferential portion 57 of reduced thickness will fail or crack at the outer curvature of such bend before any longitudinal cracks can occur in the centralizer body. In addition, any portions of the intermediate body portion which may flake off will be of small dimension due to the fact that the area thereof subjected to compressional forces, at the inner curvature of such bend, is of reduced diameter. Any portions of the portion 57 which may crack or flake off while the centralizer is located in the tubing will be of very small dimensions and will be carried out of the tubing by the upwardly flowing well fluids.

As was pointed out above, any failure or cracking of the centralizers is most likely to occur during the handling of the sections of the rod string during their installation or removal from the tubing at the well head. In such handling, the top end of the rod string section is suspended while the lower end is moved laterally toward the well head from a vertical rack or from the well head to the rack. Obviously, if such section is not held at all times perfectly perpendicular it is subjected to lateral forces tending to bend the rods of such rod string.

The foregoing description of the invention is explanatory only and changes in the details of the construction illustrated may be made by those skilled in the art, within the scope of the appended claims, without departing from the spirit of the invention.

What is claimed as new and desired to be secured by Letters Patent is:

1. A well tool including: a pump rod and a centralizer having a single piece cylindrical body rigidly mounted on said rod, an upper pair of ribs integral with an upper portion of said body and extending outwardly therefrom in opposite directions, and a lower pair of ribs integral with a lower portion of said body and extending outwardly therefrom in opposite directions, said lower pair of ribs being displaced on said body from said upper pair of ribs ninety degrees about the central longitudinal axis of said rod, said body having a circumferential intermediate portion integral with said upper and lower portions between the top ends of said lower ribs and the bottom ends of said upper pair of ribs, said intermediate portion of the body being of lower mechanical strength than said portions thereof provided with said ribs.

2. The well tool of claim 1, wherein said intermediate portion is of smaller external diameter than said upper and lower body portions.

3. The well tool of claim 1, wherein said intermediate portion has circumferential groove.

* * * * *